US007415753B2

(12) United States Patent
Kusayama et al.

(10) Patent No.: US 7,415,753 B2
(45) Date of Patent: Aug. 26, 2008

(54) SLIDE FASTENER

(75) Inventors: Masahiro Kusayama, Toyama (JP); Kiyomasa Segawa, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/448,285

(22) Filed: Jun. 7, 2006

(65) Prior Publication Data

US 2006/0282998 A1 Dec. 21, 2006

(30) Foreign Application Priority Data

Jun. 20, 2005 (JP) ..... 2005-179785

(51) Int. Cl.
*A44B 19/38* (2006.01)

(52) U.S. Cl. ..... 24/386; 24/433

(58) Field of Classification Search ..... 24/388, 24/433, 434, 386

See application file for complete search history.

(56) References Cited

U.S. PATENT DOCUMENTS 2,553,230 A * 5/1951 Bashover ..... 24/386
6,615,458 B2 * 9/2003 Takasawa et al. ..... 24/433

* cited by examiner

*Primary Examiner*—James R Brittain
(74) *Attorney, Agent, or Firm*—Alston & Bird LLP

(57) ABSTRACT

A slide fastener, wherein in the fastener chain openable and closable from both ends thereof, a box pin and the insert pin, which can join with or separate from each other, are provided at least on an end of the fastener chain; and a protrusion facing the insert pin and projecting from an opposing face is provided at a front end of the box pin; the protrusion has slopes inclined in a direction of approaching the insert pin on upper and lower sides of the protrusion; and the lower side of the protrusion makes contact with a diamond of the reverse opening slider, while the upper side of the protrusion can guide the insert pin smoothly when the pin is inserted.

6 Claims, 9 Drawing Sheets

SLIDE FASTENER

BACKGROUND OF THE INVENTION

1. Field of the Invention

The present invention relates to a separable bottom end stop for a slide fastener. The separable bottom end stop is formed of a box pin and an insert pin, an upward opening slider and a reverse opening slider are loaded on a fastener chain, and the box pin and the insert pin are improved, thereby achieving a smooth separation and insertion of those pins.

2. Description of the Related Art

Conventionally, Japanese Patent Application Laid-Open No. 2002-136309 has disclosed a separable bottom end stop for a slide fastener, as shown in FIG. 9, in which an expanded portion 41' which allows an insert pin 6' to retreat is provided on an outer side face at a front end of a box pin 5', and a projecting portion is provided on a rear face at a corner portion of the front end of the box pin in order to prevent a reverse opening slider 8' from escaping, so that the projecting portion can make contact with and engage with a front end of a lower plate of the reverse opening slider 8'. The insert pin 6' has a side face 42' which can push up a locking pawl 30' provided on the reverse opening slider 8' gradually, the side face 42' provided from a front end of a surface of the insert pin 6' up to a recess 22' capable of accommodating the locking pawl 30'.

In a fastener chain having the reverse opening slider 8' shown in FIG. 9, when the insert pin 6' is inserted into an upward opening slider 7' in a condition that the reverse opening slider 8' and the upward opening slider 7' loaded on the fastener chain are kept in contact with each other on the box pin 5' at the bottom end of the fastener chain, the front end of the insert pin 6' makes contact with the top end of a diamond 28' of the reverse opening slider 8', so that the insert pin 6' can not be inserted or fitted smoothly. Further, the projecting portion is provided on the rear face at the corner of the front end of the box pin 5', and is formed so as to make contact with and engages with the front end of the lower plate of the reverse opening slider 8'. Therefore, it is difficult to accommodate the box pin 5' in a body of the slider completely to be hidden, so that an appearance of the slide fastener is not good to see.

SUMMARY OF THE INVENTION

The present invention has been achieved in views of the above-described problem. A main object of the invention is to provide a separable bottom end stop for a slide fastener, which can be opened or closed from both ends of a fastener chain and allow an insert pin to be inserted and fitted smoothly without any collision with a diamond of a reverse opening slider when the insert pin is inserted with an upward opening slider kept in contact with the reverse opening slider, a side face on a lower side avoiding the diamond of the reverse opening slider, so that a side of the separable bottom end stop of the fastener chain can be opened smoothly.

In addition, it is another object of the invention to provide a separable bottom end stop for a slide fastener, in which a position where a protrusion approaches the insert pin most is located on a same line as a vertex of the diamond or located at a insert pin side with respect to the vertex, thereby achieving the inserting and fitting work of the insert pin easily and securely.

Another object of the invention is to provide a separable bottom end stop for a slide fastener, in which a protrusion projecting in a direction of a side of the box pin is provided on the box pin so as to allow the insert pin to be inserted and fitted smoothly and securely without a collision with the diamond of the reverse opening slider.

Still another object of the invention is to provide a separable bottom end stop for a slide fastener, in which the insert pin can be inserted easily and smoothly into the upward opening slide and the reverse opening slider by providing the side face of the box pin with a dented portion.

Further, another object of the invention is to provide a separable bottom end stop for a slide fastener, in which projecting portions for preventing the reverse opening slider from dropping down are provided protrudedly on both the front and rear faces of the box pin, so that the box pin is accommodated into the body of the reverse opening slider, thereby providing the slide fastener with a good appearance.

Another object of the present invention is to provide a separable bottom end stop for a slide fastener, in which the box pin is completely concealed in the body of the reverse opening slider, and the box pin can be securely engaged in the body of the reverse opening slider.

Still further object of the invention is to provide a separable bottom end stop for a slide fastener, in which each of the upward opening slider and the reverse opening slider loaded on the fastener chain includes an automatic locking mechanism having a locking pawl.

To achieve the above-described object, according to the main aspect of the present invention, there is provided a slide fastener having two sliders of an upward opening slider and a reverse opening slider, which are disposed such that rear mouths of the sliders face each other, the slide fastener capable of being opened and closed from both ends of the slide fastener, characterized in that the slide fastener comprises a box pin and an insert pin as a separable bottom end stop on at least one end of the slide fastener; a protrusion projecting from an opposing face is formed at a free end of the box pin, the opposing face facing the insert pin; and the protrusion has side faces, which become narrower progressively in a direction approaching the insert pin in a top view, on upper and lower sides of the protrusion.

Since the protrusion projecting from the opposing face is provided at the front end of the box pin and the protrusion has the side faces approaching the insert pin on the upper and lower sides thereof, the side face on the upper side can guide the insert pin smoothly, so that the inserting and fitting operation of the insert pin into the reverse opening slider can be carried out easily and securely. In addition, the side face on the lower side avoids the diamond of the slider, thereby allowing the fastener to be opened smoothly from the side of the separable bottom end stop.

Preferably, a position where the protrusion approaches the insert pin most is located on a same line as a vertex of a diamond of at least one of the upward opening slider and the reverse opening slider, or located at an insert pin side with respect to the vertex.

Consequently, the inserting and fitting operation of the insert pin can be carried out more easily and securely, and the side face on the lower side avoids the diamond of the reverse opening slider, thereby allowing the fastener to be opened smoothly from the side of the separable bottom end stop.

Further preferably, the side face on the lower side of the protrusion is formed so as to face a diamond of a reverse opening slider, when the box pin is inserted into the reverse opening slider.

Consequently, the protrusion of the box pin can be brought into secure contact with an inner end of the diamond of the reverse opening slider and a corner portion at the front end of the insert pin, thereby achieving the insertion operation of the insert pin into the reverse opening slider smoothly.

In addition, it is preferable that the insert pin has a projecting and recessed row, which is extending in a length direction, on a portion of the insert pin facing the box pin; and the insert pin has a dented portion formed between the side face on the upper side of the protrusion and an opposite portion that makes contact with the projecting and recessed row of the insert pin, such that the dented portion is continuous from the side face on the upper side.

Consequently, the front end of the insert pin can be prevented from colliding with the locking pawl of the reverse opening slider when the insert pin is inserted into the reverse opening slider, so that the front end of the insert pin can be guided effectively, thereby achieving a smooth insertion.

Preferably, projecting portions for preventing a reverse opening slider from dropping down are provided protrudedly on front ends of both front and rear faces of the box pin.

Consequently, the box pin and the engaging insert pin are accommodated in the body of the reverse opening slider and not exposed outside, so that there is no fear that the box pin and the insert pin may be caught by other thing and damaged, whereby the fastener chain is finished with a presentable appearance Further preferably, concave portions are formed in an inner face of a shoulder mouth of the reverse opening slider, and the projecting portions are formed so as to be capable of making contact with concave portions.

As a consequence, the box pin can be accommodated in the body of the reverse opening slider securely, and thus, the box pin and the engaging insert pin are accommodated in the body easily, so that the box pin and insert pin can be concealed completely.

Preferably, locking pawls are provided so as to protrude in parts of respective inner faces of the upward opening slider and the reverse opening slider, recesses to be engaged with the locking pawls are provided in the box pin and the insert pin, and the recesses are provided concavely on opposite surfaces of the box pin and the insert pin, respectively.

As a consequence, a separable bottom end stop capable of exerting an excellent operation and effect can be achieved, and the effects which the present invention attains are very remarkable.

DETAILED DESCRIPTION OF THE PREFERRED EMBODIMENTS

Figure 1:
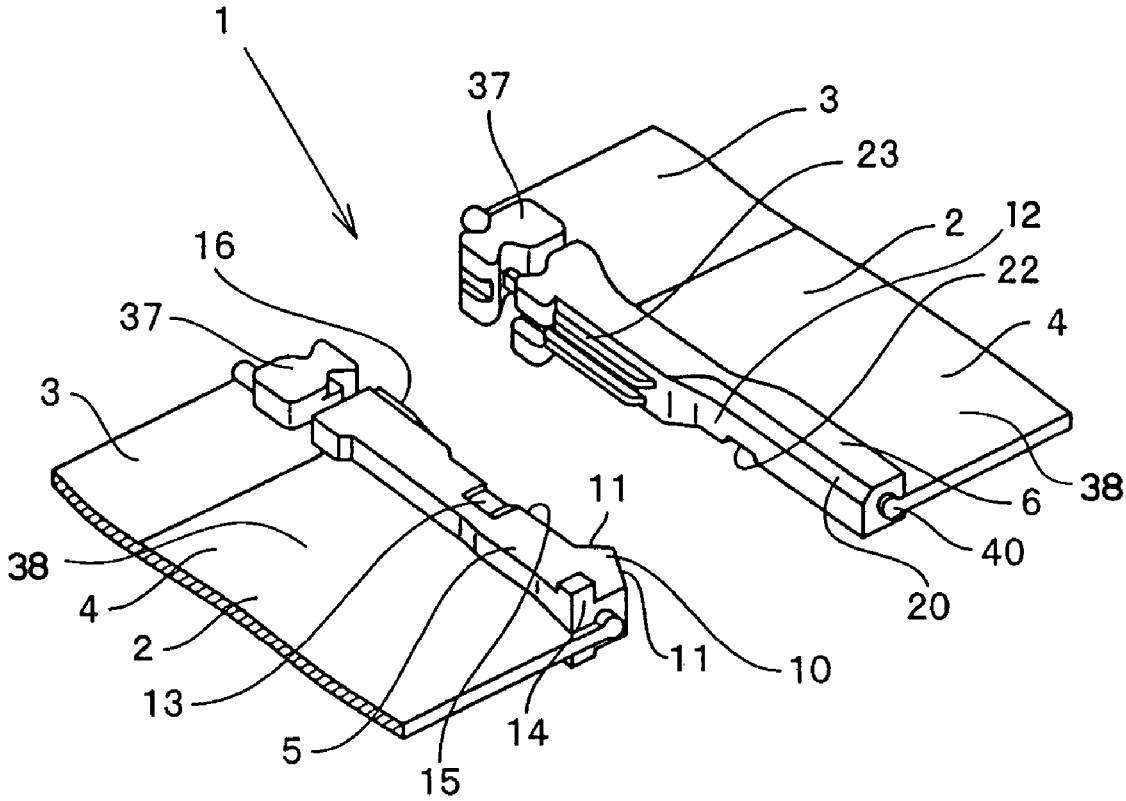
FIG. 1 is a perspective view showing a box pin and an insert pin of a reverse opening type separable bottom end stop according to a first embodiment.

In a separable bottom end stop for a slide fastener according to the present invention, as shown in FIGS. 1 to 7, fastener elements 37 composed of thermoplastic resin in a single unit are mounted on side edges of fastener tapes 3 constituting fastener stringers 2 in a fastener chain 1 by injection molding means, and reinforcement tapes are bonded to space portions produced by removing the fastener elements of the fastener chain. Then, a substantially rectangular box pin 5 is mounted on one of the space portions while a substantially rectangular insert pin 6 is mounted on the other one of the space portions by injection molding means using thermoplastic resin.

As for the configuration of the box pin 5, a protrusion 10 projecting in a triangular shape is provided outside of a bottom end portion, namely, on an opposing face 12 which opposes the insert pin 6. In addition, a side face 11 on the upper side of the protrusion 10 guides the insert pin 6 while a side face 11 on the lower side makes contact with a diamond 28 of a reverse opening slide 8. A projecting opposite portion 16 which engages projecting and recessed rows 23 provided on the insert pin 6 is formed on the upper portion of the opposing face 12 of the box pin 5, and a dented portion 15, which is dented in a concave shape, is formed between the opposite portion 16 and the protrusion 10. Further, projecting portions 14 are provided on corner portions of both front and rear faces of the box pin 5 equipped with the protrusion 10, so that the reverse opening slider 8 makes contact with the projecting portions 14 to prevent the reverse opening slider 8 from dropping from the box pin 5. Here, the protrusion 10 in the triangular shape includes a triangle, of course, but it also includes the case that at least one of both side faces on upper and lower sides is curved outward or inward.

When the box pin 5 is disposed on a left side with respect to the fastener chain 1, a recess 13 is provided at a portion corresponding to a locking pawl 30 provided on the reverse opening slider 8 in the surface of the box pin 5, so that the locking pawl 30 can be accommodated in the recess 13 securely.

As for the configuration of the insert pin 6, the side face facing the box pin 5 is formed linearly, and the projecting and recessed rows 23 which engage the projecting opposite portion 16 provided in the box pin 5 is formed on the outer side of a top end of the insert pin 6. An outside corner portion of the insert pin 6 when facing the box pin 5, the outside corner potion being below the projecting and recessed rows 23, is cut out obliquely to form a chamfered portion 20, so that the locking pawl 30 of the reverse opening slider 8 is prevented from colliding with the insert pin 6 when the insert pin 6 is inserted.

A recess 22 capable of accommodating the locking pawl 30 provided on the reverse opening slider 8 is provided on an opposite face to the face having the chamfered portion 20 for the case that the insert pin 6 is used in a right insertion type of the bottom end stop, and further, a side face portion 21 is formed by cutting out the inside corner portion at the front end of the insert pin 6 obliquely. As a consequence, the insertion operation of the insert pin 6 to the upward opening slider 7 and the reverse opening slider 8 is facilitated.

First Embodiment

A separable bottom end stop for a slide fastener according to the present invention will be described. In a separable bottom end stop for a slide fastener according to a first embodiment shown in FIGS. 1 to 7, fastener elements 37 in a single unit are mounted on swollen core threads 40 with respect to fastener tapes 3, the core threads being fixed on side edges of the fastener tapes 3 constituting fastener stringers 2 in a fastener chain 1, by injection molding means using thermoplastic resin such as polyamide, polyacetal, polypropylene, and polybutylene terephthalate. Then, space portions are formed by removing the fastener elements 37 in a specified interval from the fastener chain 1 equipped with the fastener elements 37, and reinforcement tapes are bonded to the space portions by using a resin film such as polyamide and polyacetal. Consequently, a substantially rectangular box pin 5 is formed on the reinforcement tape on one fastener stringer 2 by injection molding using resin while a substantially rectangular insert pin 6 is formed on the other fastener stringer 2 by injection molding.

A protrusion 10 projecting in a triangular shape is provided outside of the bottom end of the box pin 5, namely, on the opposing face 12 which opposes the insert pin 6. The side face 11 on the upper side of the protrusion 10, the upper side meaning a side having the fastener elements 37 mounted on the fastener tape 3, guides the front end of the insert pin 6 in a direction of leaving the box pin 5 while the side face 11 on the lower side makes contact with the inner face of the diamond 28 of the reverse opening slider 8 loaded on the fastener stringers 2. A vertex in which the upper and lower side faces 11 meet is preferred to be located at a insert pin 6 side with respect to the vertex of the diamond 28 of the reverse opening slider 8. An opposite portion 16 providing a dense row, which can engage projecting and recessed rows 23 provided on the opposing face 12 of the insert pin 6, is formed on the upper portion of the opposing face 12 of the box pin 5. A dented portion 15 is formed between the opposite portion 16 and the protrusion 10, the entire surface of the dented portion 15 being dented concavely with respect to the surface of the box pin 5, and the dented portion 15 guides the insertion of the insert pin 6 into the box pin 5 disposed in the reverse opening slider 8 stably when the insert pin 6 is inserted. As a consequence, the insertion of the front end of the insert pin 6 is not blocked by collision with the box pin 5. In the meantime, the side face 11 may be formed circularly without being restricted to a linear shape.

Projecting portions 14 projecting outwardly are provided on the corner portions on both front and rear faces at the inner side of the bottom end of the box pin 5, namely, at the inner side of the edge portion of the fastener tape 3. Step portions formed by concave portions 29 of the reverse opening slider 8 loaded on the fastener stringers 2 make contact with the projecting portions 14, thereby preventing the reverse opening slider 8 from escaping from the box pin 5 and dropping down from the fastener stringers 2. When the box pin 5 is disposed to the left side of the fastener chain 1, by providing a recess 13 having a concave shape in a portion in the surface of the box pin 5, the portion corresponding to a locking pawl 30 of an automatic locking mechanism, the automatic locking mechanism provided in the reverse opening slider 8, the locking pawl 30 is accommodated accurately and easily in the recess 13.

The opposing face 12 of the insert pin 6 facing the box pin 5 is formed linearly, and the projecting and recessed rows 23 which engage the opposite portion 16 provided on the box pin 5 protrudedly is formed on the opposing face 12 at the top end portion of the insert pin 6, and a corner portion of the insert pin 6 on the same side, where the recess 13 is formed in the box pin 5, is cut out obliquely between the projecting and recessed rows 23 and the front end of the insert pin 6, so as to form a chamfered portion 20. Consequently, the locking pawl 30 of the automatic locking mechanism can be avoided when the insert pin 6 is inserted into the upward opening slider 7 and the reverse opening slider 8.

Figure 2:
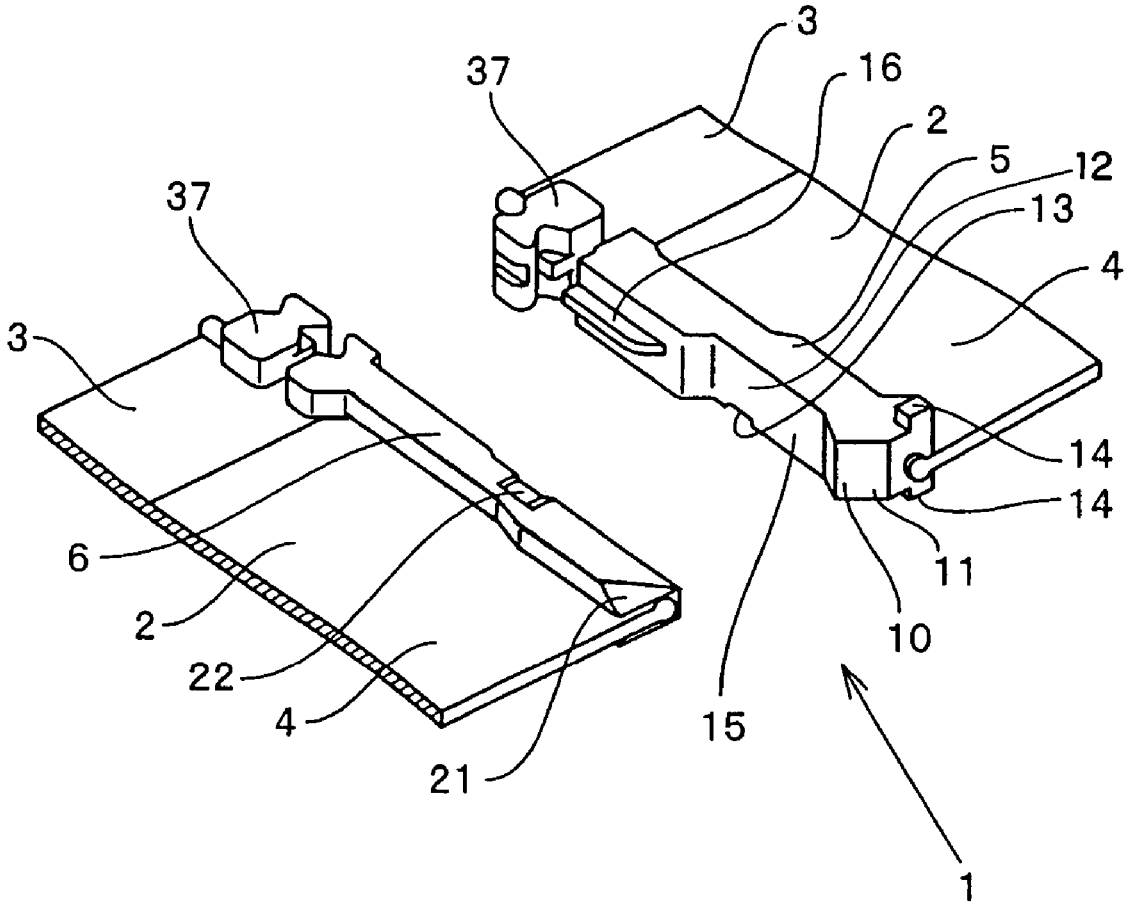
FIG. 2 is a perspective view showing back faces of the box pin and insert pin of the separable bottom end stop.
Figure 7:
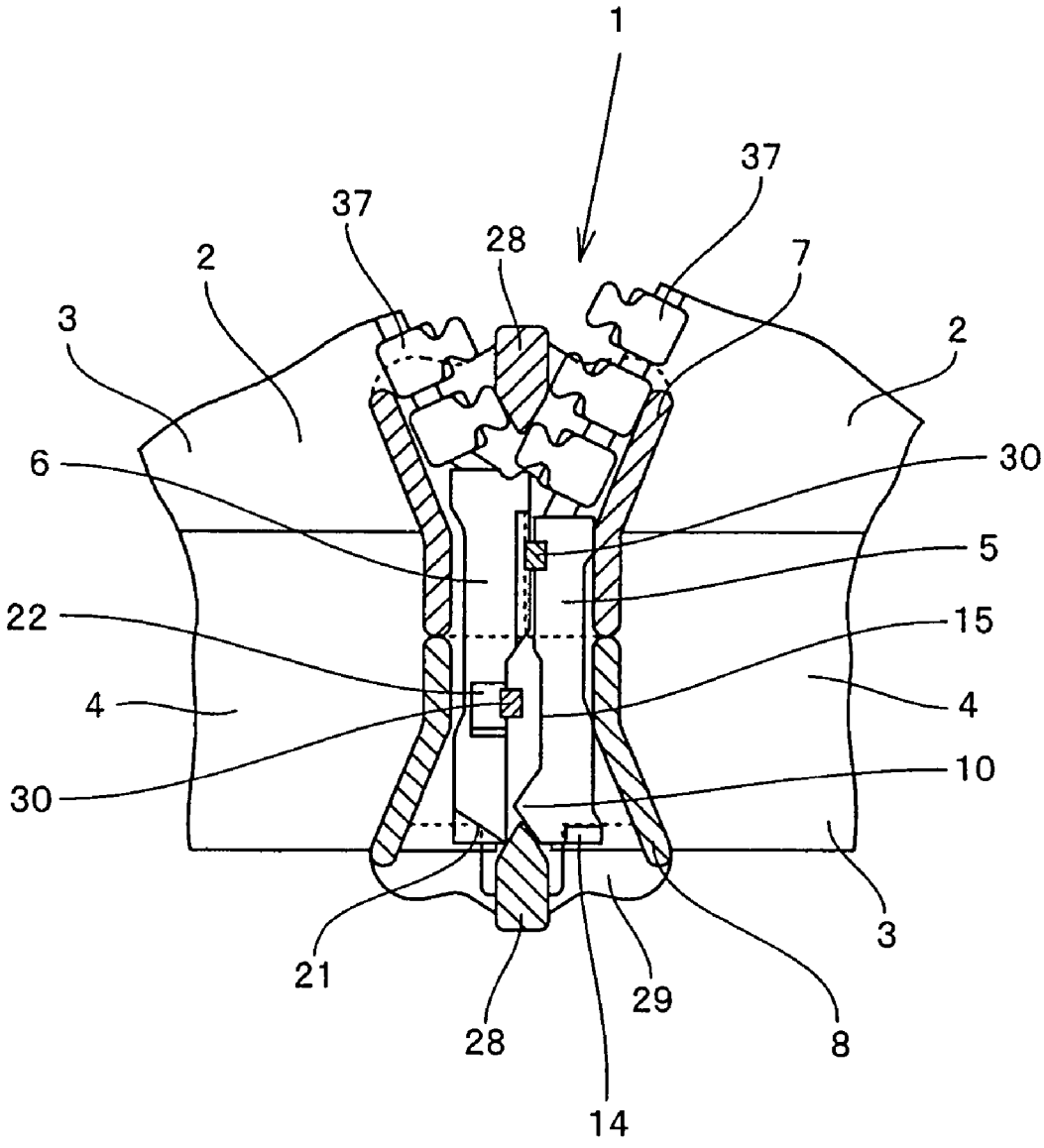
FIG. 7 is a partial sectional view showing a back face of the separable bottom end stop in FIG. 4.

On an opposite face to the chamfered portion 20 formed on the insert pin 6, the recess 22 dented in the concave shape and capable of accommodating the locking pawl 30 of the automatic locking mechanism provided on the reverse opening slider 8 is provided in the surface of the insert pin 6, in the case the insert pin 6 is used in the right insertion type of the bottom end stop, namely, as shown in FIG. 7. Further, a side face portion 21 is formed by obliquely cutting out the corner portion inside of the front end of the insert pin 6 as shown in FIG. 2. Provision of the side face portion 21 facilitates the insertion operation of the insert pin 6 into the upward opening slider 7 and the reverse opening slider 8 loaded on the fastener chain 1. Particularly in case of the right insertion type as shown in FIG. 7, the insert pin 6 can be inserted easily with the locking pawl 30 of the reverse opening slider 8 guided such that the locking pawl is raised.

Figure 6:
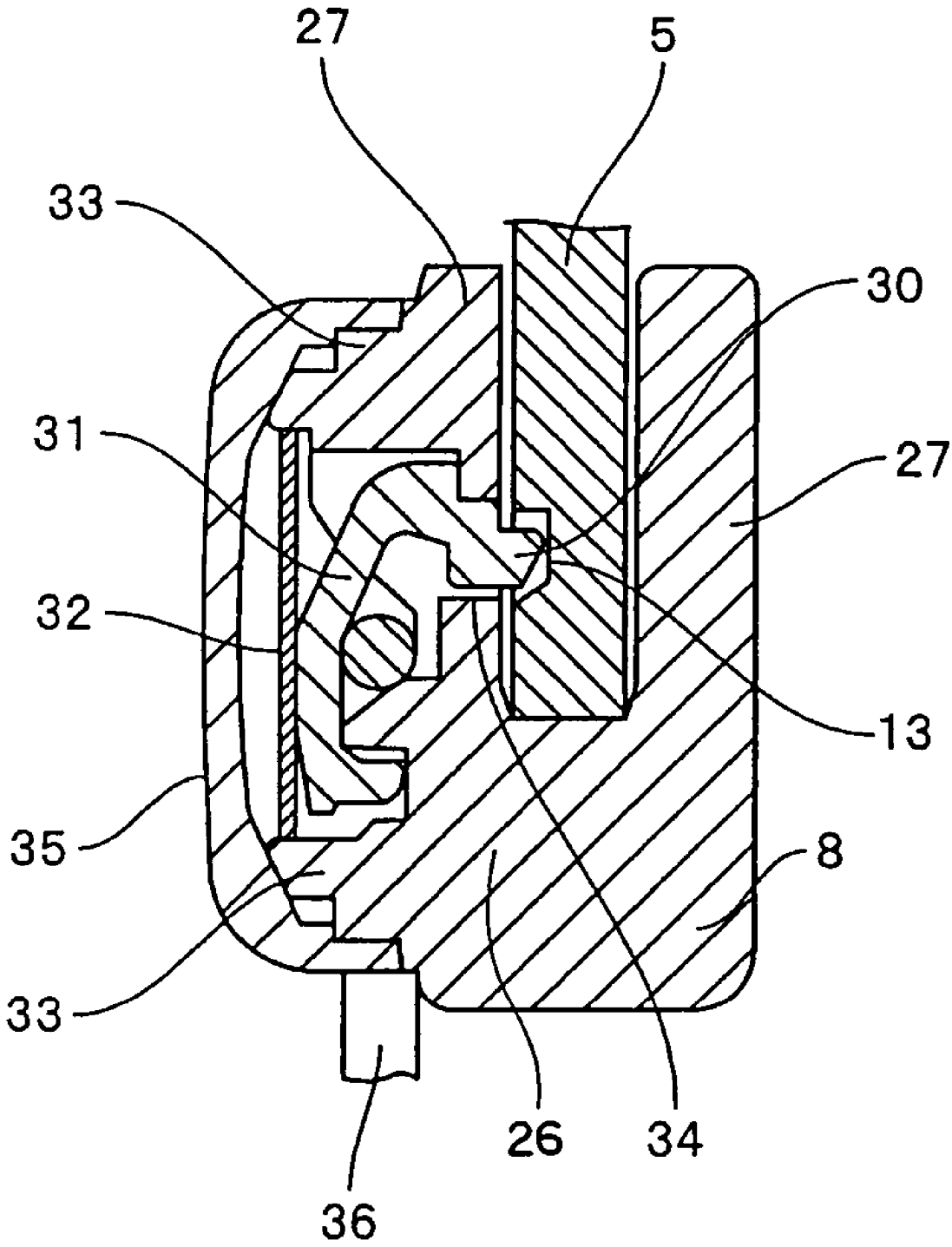
FIG. 6 is a sectional view of the separable bottom end stop taken along the line VI-VI of FIG. 4.

The upward opening slider 7 and the reverse opening slider 8 used in the present invention are formed of the same type sliders as shown in FIG. 6. In each of the sliders 7 and 8, upper and lower plates 27 are connected to a body 26 with the diamond 28, mounting posts 33 are erected at the front and rear portions of the upper plate 27, and a pawl hole 34 which enables the locking pawl 30 provided on a pawl lever 31 to project into the body 26 is provided between the mounting posts 33. The body 26 supports an end of the pawl lever 31 swingably on the shoulder mouth side of the body 26 between the front and rear mounting posts 33, and a pivot shaft of a pull tab 36 is placed below the intermediate portion of the pawl lever 31, so that a spring 32 and a cover 35 are fixed to the mounting posts 33 from above. The concave portions 29 having smaller thickness than other portions are formed on the side of the diamond 28 of the upper and lower plates 27, and the projecting portions 14 of the box pin 5 enter the concave portions 29. In the meantime, the concave portions 29 may be provided on only the side of the box pin 5. The reverse opening slider 8 may adopt a special slider. In this special slider, both sides of the body are parallel to each other, a square shape is provided as seen from the front side (upside), and a dented portion capable of receiving the upward opening slider is formed in the top end of the slider.

Giving a description of the use condition of the separable bottom end stop for the slide fastener, a top end stop is mounted with resin by injection molding means on the core thread 40 so as to be continuous to the fastener elements 37 of one fastener stringer 2 of the fastener chain 1, for example, the fastener stringer 2 provided with the box pin 5, thereby preventing the upward opening slider 7 from dropping down in cooperation with the top end stop on the insert pin 6 side. Of course, the top end stop may be metallic. Further, a top end stop is mounted on the core thread 40 so as to be continuous to the fastener elements 37 of the other fastener stringer 2, for example, the fastener stringer 2 provided with the insert pin 6, thereby preventing the upward opening slider 7 from dropping down in cooperation with the top end stop on the box pin 5 side.

Figure 3:
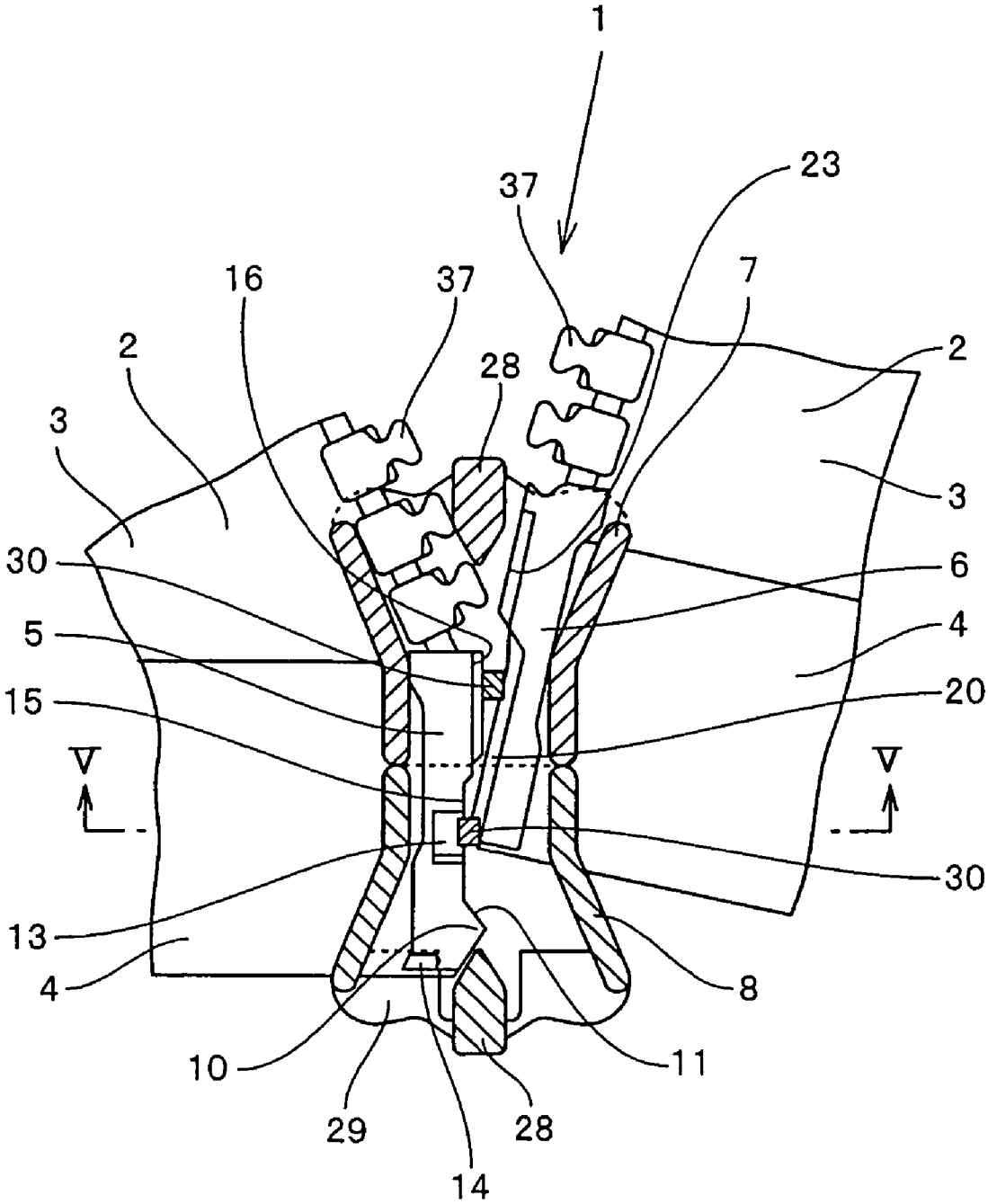
FIG. 3 is a partial sectional view showing an intermediate state of an inserting and fitting operation of the insert pin of the separable bottom end stop.
Figure 4:
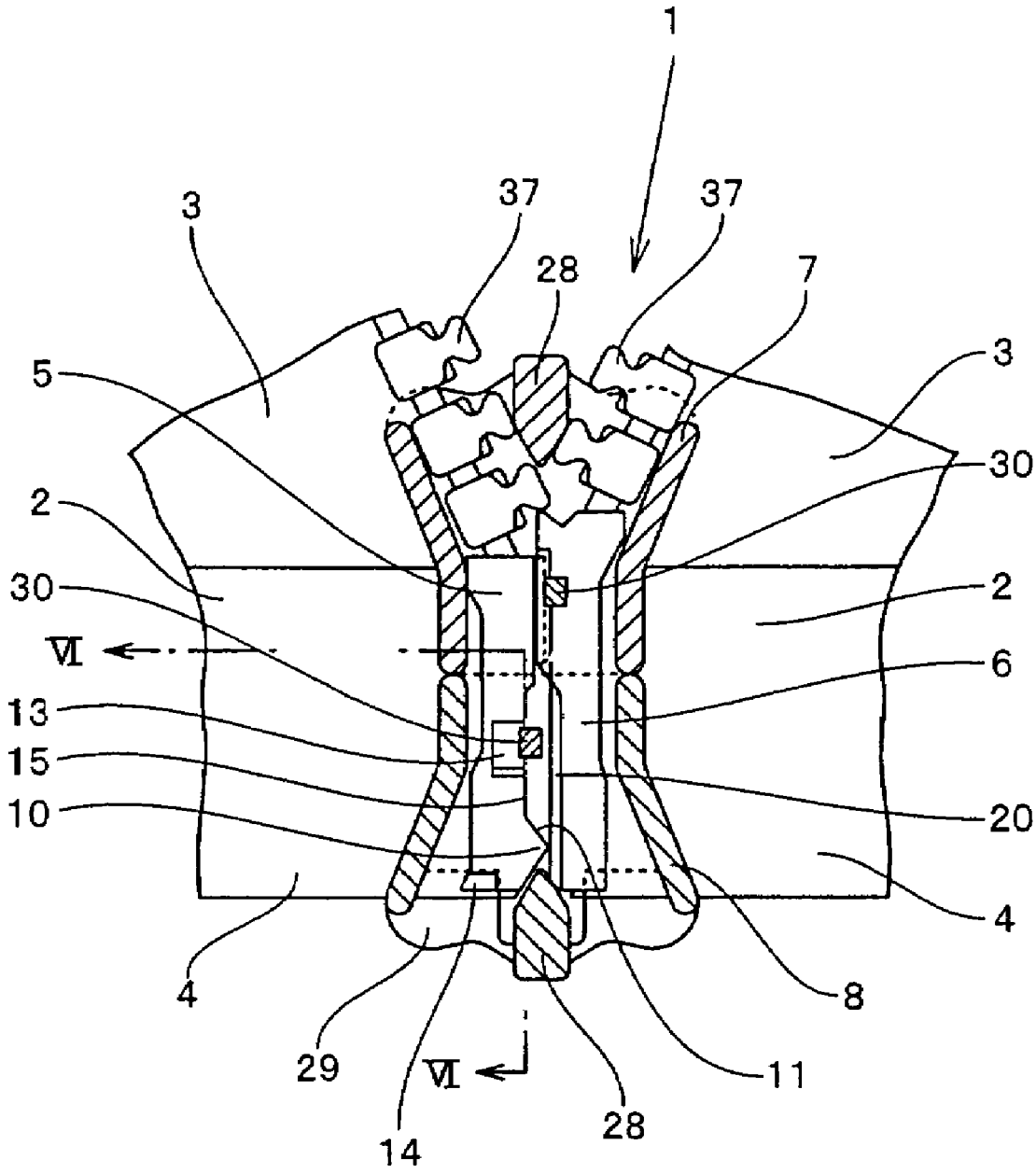
FIG. 4 is a partial sectional view showing a completion state of the inserting and fitting operation of the insert pin of the separable bottom end stop.
Figure 5:
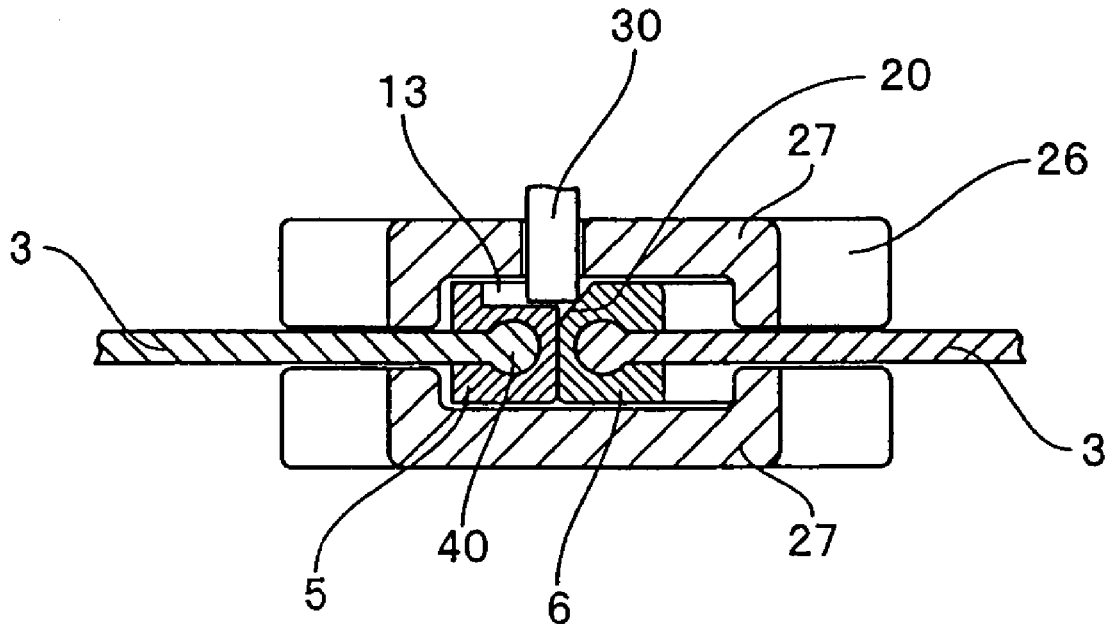
FIG. 5 is a sectional view of the separable bottom end stop taken along line V-V in FIG. 3.

First, the reverse opening slider 8 is loaded on the box pin 5 from the side of the top end stop of the fastener stringer 2 provided with the box pin 5. Next, the upward opening slider 7 is loaded from the side of the top end stop of the fastener stringer 2 and overlapped with the reverse opening slider 8 mounted on the box pin 5. In this state, the fastener stringer 2 provided with the insert pin 6 is inserted into the upward opening slider 7 and the reverse opening slider 8 with the insert pin 6 first, as shown in FIG. 3, and in the next operation, the fastener stringer 2 is inserted in a state shown in FIG. 4. Thereafter, by sliding the upward opening slider 7 upward, the fastener chain 1 is closed.

To release the fastener chain 1, the upward opening slider 7 is overlapped with the reverse opening slider 8 disposed at the end portion of the fastener chain 1, and then, the insert pin 6 is pulled out from the reverse opening slider 8 and the upward opening slider 7, so that the fastener chain 1 can be released to the right and left fastener stringers 2. Further, by sliding the reverse opening slider 8 in a direction to the top end stop, the fastener chain 1 can be opened from the side of the box pin 5 and the insert pin 6, and consequently, the fastener chain 1 can be opened from both sides.

Second Embodiment

Figure 8:
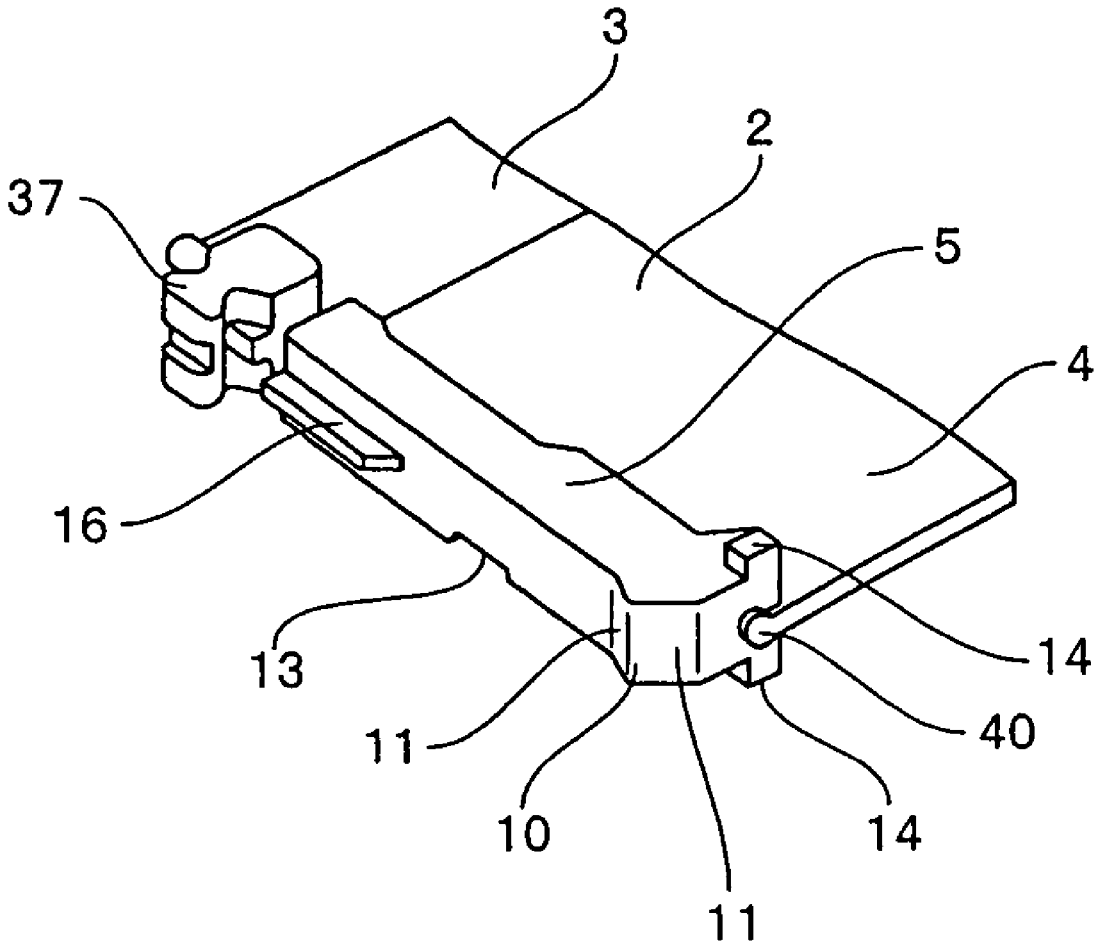
FIG. 8 is a perspective view showing a box pin of a separable bottom end stop according to a second embodiment.
Figure 9:
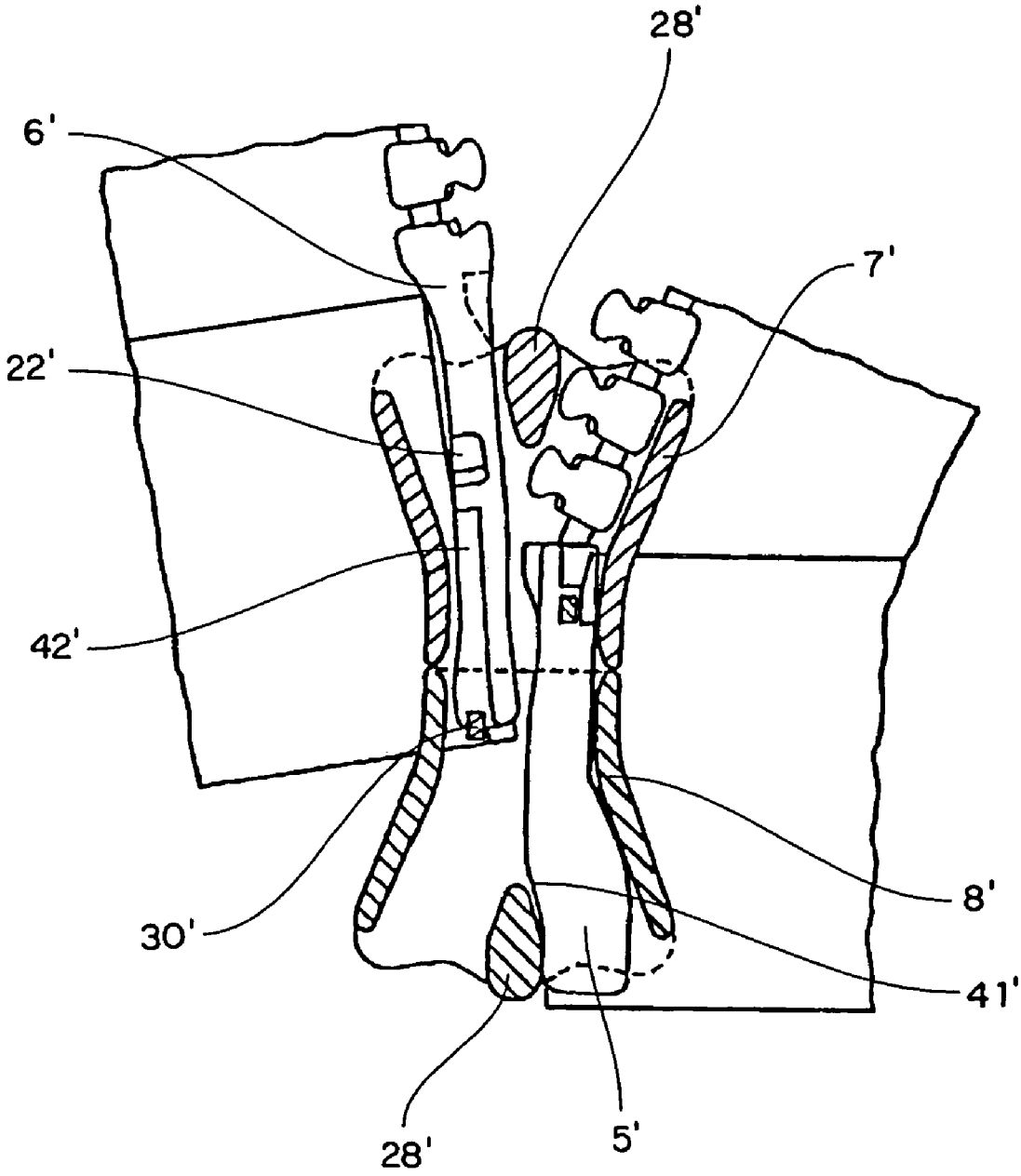
FIG. 9 PRIOR ART
FIG. 9 is a partial sectional view showing an initial state of an inserting and fitting operation of an insert pin of a well known separable bottom end stop.

A separable bottom end stop for a slide fastener according to a second embodiment shown in FIG. 8 shows a modification of the box pin 5 mounted on the fastener stringer 2. As for the configuration of the box pin 5, the box pin 5 mounted on the core thread 40 of the fastener tape 3 with resin by injection molding is substantially rectangular, and the projecting opposite portion 16 capable of engaging the projecting and recessed rows 23 provided on the insert pin 6 is provided on the opposing face 12 to the insert pin 6 of the box pin 5 on the upper side of the box pin 5. The protrusion 10 projecting triangularly is provided on the opposing face 12 at the bottom end portion of the box pin 5, and the projecting portions 14 are provided on the corner portions of both front and rear faces and the recess 13 capable of accommodating the locking pawl 30 of the automatic locking mechanism is provided. The box pin 5 of this embodiment is different from the box pin 5 of the previous embodiment in that no dented portion is provided between the opposite portion 16 and the protrusion 10 on the opposing face 12.

The slide fastener having the separable bottom end stop for the slide fastener of the invention at an end portion of the slide fastener is used at a fly of clothes, an opening portion of clothes, and an opening/closing portion of every product such as bags.

What is claimed is:

1. A slide fastener having two sliders of an upward opening slider and a reverse opening slider, which are disposed such that rear mouths of the sliders face each other, the slide fastener capable of being opened and closed from both ends of the slide fastener, wherein the slide fastener comprises a box pin and an insert pin as a separable bottom end stop on one end of the slide fastener, a protrusion projecting from an opposing face is formed at a free end of the box pin, the opposing face facing the insert pin, an opposite portion which makes contact with the opposing face facing the insert pin is provided at an end of the box pin on an opposite side of the free end, the protrusion has slopes, which become narrower progressively in a direction approaching the insert pin in a top view, on upper and lower sides of the protrusion, respectively, the slope on the upper side of the protrusion constitutes a guide surface for guiding the insert pin when the insert pin is inserted, the slope on the lower side of the protrusion is constituted so as to make contact with a diamond of the reverse opening slider when the box pin is inserted into the reverse opening slider, and a dented portion is formed between the slope on the upper side of the protrusion and the opposite portion such that the dented portion is continuous from the slope on the upper side.

2. The slide fastener according to claim 1, wherein a position where the protrusion approaches the insert pin most is located on a same line as a vertex of a diamond of at least one of the upward opening slider and the reverse opening slider, or located at an insert pin side with respect to the vertex.

3. The slide fastener according to claim 1, wherein the insert pin has a projecting and recessed row, which is extending in a length direction, on a portion of the insert pin facing the box pin.

4. The slide fastener according to claim 1, wherein projecting portions for preventing a reverse opening slider from dropping down are provided protrudedly on front ends of both front and rear faces of the box pin.

5. The slide fastener according to claim 4, wherein concave portions are formed in an inner face of a shoulder mouth of the reverse opening slider, and the projecting portions are formed so as to be capable of making contact with concave portions.

6. The slide fastener according to claim 1, wherein locking pawls are provided so as to protrude in parts of respective inner faces of the upward opening slider and the reverse opening slider, recesses to be engaged with the locking pawls are provided in the box pin and the insert pin, and the recesses are provided concavely on opposite surfaces of the box pin and the insert pin, respectively.

* * * * *